US005850965A

United States Patent [19]

Boyls et al.

[11] Patent Number: 5,850,965

[45] Date of Patent: Dec. 22, 1998

[54] REINFORCED CONTAINER

[75] Inventors: Derek W. Boyls, Austin; John W. Bridges, Pflugerville, both of Tex.

[73] Assignee: Dell USA, L.P., Round Rock, Tex.

[21] Appl. No.: 877,693

[22] Filed: Jun. 17, 1997

[51] Int. Cl.[6] ..... B65D 5/28

[52] U.S. Cl. ..... 229/191; 229/193; 229/192; 229/198.2

[58] Field of Search ..... 229/191, 184, 229/183, 192, 193, 198.2, 132, 918, 199; 206/503

[56] References Cited

U.S. PATENT DOCUMENTS

| | | | |
|---|---|---|---|
| 1,653,116 | 12/1927 | Parks | 229/191 |
| 2,444,895 | 6/1948 | Ringler | 229/132 |
| 3,034,689 | 1/1962 | Forrer | 229/191 X |
| 3,375,967 | 4/1968 | Robinson | 229/191 X |
| 4,056,223 | 11/1977 | Williams | 229/191 X |
| 4,133,474 | 1/1979 | Hall | 229/23 R |
| 4,341,338 | 7/1982 | Arnold | 229/23 BT |
| 4,417,686 | 11/1983 | Wozniacki | 229/193 X |
| 4,874,125 | 10/1989 | Bates | 229/132 |
| 5,294,044 | 3/1994 | Clark | 299/191 |
| 5,535,941 | 7/1996 | Garza | 229/191 |
| 5,588,585 | 12/1996 | McClure | 229/191 |

FOREIGN PATENT DOCUMENTS

| | | | |
|---|---|---|---|
| 088000753A | 10/1989 | Netherlands | 229/918 |

*Primary Examiner*—Allan N. Shoap
*Assistant Examiner*—Tri M. Mai
*Attorney, Agent, or Firm*—Skjerven, Morrill, MacPherson, Franklin & Friel, L.L.P.; Stephen A. Terrile; David G. Dolezal

[57] ABSTRACT

A reinforced container includes four exterior panels and four supports. Three of the supports are integrally connected to two exterior panels that are positioned to form an edge of the container. The supports can be secured to the interior sides of the exterior panels. The reinforced container can be made from folding a single sheet of corrugated fiberboard.

35 Claims, 7 Drawing Sheets

FOLD 2

FOLD 4

FOLD 5

FOLD 1

FOLD 3

REINFORCED CONTAINER

BACKGROUND OF THE INVENTION

1. Field of the Invention

The present invention relates to packaging and more particularly to a reinforced container.

2. Description of the Related Art

Generally, equipment, such as computer equipment, is shipped and sold in fiberboard containers, i.e. boxes. The shape of the containers allows the equipment to be stacked neatly and efficiently in storage. However, one problem in stacking containers containing equipment is that the bottom container of a stack must support the weight of the containers stacked on top. When the equipment stored in the container is heavy, the weight of several rows of containers can greatly exceed the capacity of a single ply fiberboard container.

To allow a container to support more weight, vertical supports made of wood or plastic tubing can be attached to the sides of the container. One such example of a container with vertical supports is a wooden crate. However, adding wood or plastic tubing increases packing costs as well as making a used container more difficult to recycle.

What is needed is a way to provide vertical support to a container without having to add expensive materials.

SUMMARY OF THE INVENTION

It has been discovered that providing a container with supports that are integrally connected to the exterior panels advantageously provides a reinforced container that can be made from a single sheet of material.

More specifically, in one aspect of the invention, a container includes a first exterior panel, a second exterior panel, and a first support integrally connected to the first exterior panel. The first support is integrally connected to the second exterior panel. The first exterior panel and the second exterior panel are positioned to form an edge of the container.

In another aspect of the invention, a sheet of material for making a container includes a first exterior panel, a second exterior panel, and a first intermediate portion integrally connected to the first exterior panel at a first joint. The first intermediate portion is integrally connected to the second exterior panel at a second joint. The first intermediate portion is bendable to form a first support when the first exterior panel is positioned with the second exterior panel to make a first edge of the container.

In another aspect of the invention, a sheet of material for making a container includes a first exterior panel, a second exterior panel, a third exterior panel, and a fourth exterior panel. The sheet of material also includes a first intermediate portion integrally connected to the first exterior panel and to the second exterior panel, a second intermediate portion integrally connected to the second exterior panel and to the third exterior panel, and a third intermediate portion integrally connected to the third exterior panel and to the fourth exterior panel. The sheet of material further includes a first flap integrally coupled to the first exterior panel, a second flap integrally coupled to the first exterior panel, a third flap integrally coupled to the second exterior panel, a fourth flap integrally coupled to the second exterior panel, a fifth flap integrally coupled to the third exterior panel, a sixth flap integrally coupled to the third exterior panel, a seventh flap integrally coupled to the fourth exterior panel, and an eighth flap integrally coupled to the fourth exterior panel. Each intermediate portion includes a first support panel integrally connected at a first joint to one of the exterior panels integrally connected to the intermediate portion, a second support panel integrally connected at a second joint to the other of the exterior panels integrally connected to the intermediate portion, a first intermediate support panel integrally connected to the first support panel at a third joint, and a second intermediate support panel integrally connected to the second support panel at a fourth joint. The first intermediate support panel and the second intermediate support panel are integrally connected at a fifth joint. The sheet of material is folded at the first joint, the second joint, the third joint, the fourth joint, and the fifth joint to form a support when the sheet is formed into a container. The sheet of material further includes a portion integrally connected to the fourth exterior panel. The portion includes a first support panel integrally connected at a first joint to the fourth exterior panel, a second support panel, a first intermediate support panel integrally connected to the first support panel at a second joint, and a second intermediate support panel integrally connected to the second support panel at a third joint. The first intermediate support panel and the second intermediate support panel are integrally connected at a fourth joint. The sheet of material is folded at the first joint, the second joint, the third joint, and the fourth joint to form a support when the sheet is formed into a container. A first side of the second support panel of the portion is secured to an interior side of the first exterior panel when the sheet is formed into a container. The first, third, fifth, and seventh flaps are positioned to form a first container side when the sheet is formed into a container. The second, fourth, sixth, and eighth flaps are positionable to form a second container side when the sheet is formed into a container.

Another advantage of the present invention is that it allows all of the vertical exterior panels and vertical supports of a corrugated fiberboard container to have a vertical corrugated direction, thereby increasing the vertical strength of the container.

Another advantage of the present invention is that a container can be reinforced with supports made of the same material as the exterior panels and flaps, thereby making the reinforced container easier to manufacture and easier to recycle.

Another advantage of the present invention is that a reinforced container can be made from a single sheet of material thereby allowing a bundle of unassembled reinforced containers to be shipped and stored in a compact manner.

Another advantage of the present invention is that a partially assembled reinforced container can be stored in the same flat manner as a partially assembled regular container.

BRIEF DESCRIPTION OF THE DRAWINGS

The present invention may be better understood, and its numerous objects, features, and advantages made apparent to those skilled in the art by referencing the accompanying drawings.

The use of the same reference symbols in different drawings indicates similar or identical items.

DETAILED DESCRIPTION

The following sets forth a detailed description of the best contemplated mode for carrying out the invention. The description is intended to be illustrative of the invention and should not be taken to be limiting.

Figure 1:
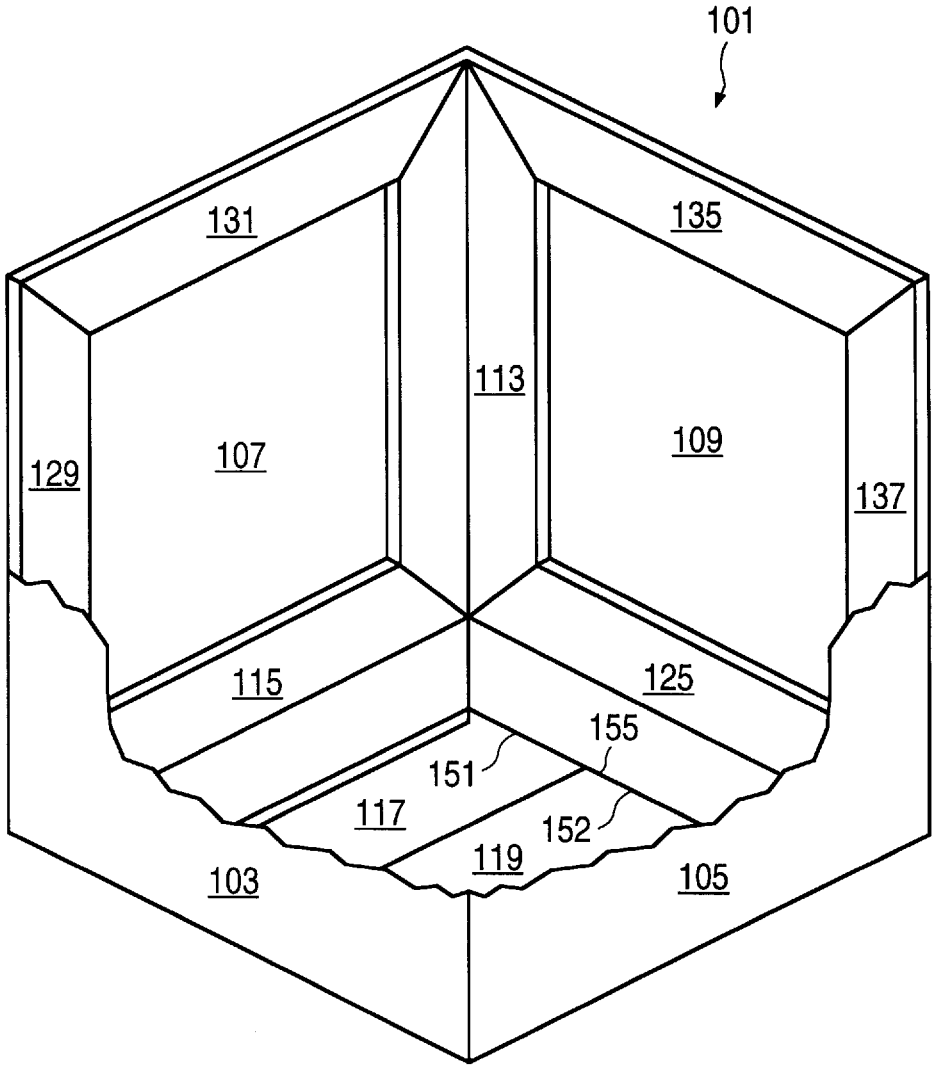
FIG. 1 is a cut-away perspective view of a container according to the present invention.

FIG. 1 shows a partially cut-away perspective view of one embodiment of a reinforced container according to the present invention. Container 101 has four exterior panels 103, 105, 107, and 109. FIG. 1 shows the exterior sides of panels 103 and 105 and the interior sides of panels 107 and 109. Container 101 also includes a vertical support 113 that is integrally connected to exterior panels 107 and 109 and secured with glue or stitching to the interior side of panel 107 and the interior side of panel 109. Horizontal support 115 is integrally connected to exterior panel 107 and flap 117 and is secured to the interior side of panel 107 and to the interior side of flap 117. Interior flaps 117 and 119 along with two other exterior flaps not shown make up the bottom side of container 101. Horizontal support 125 is integrally connected to exterior panel 109 and to a flap not shown. Support 125 is secured to the interior side of exterior panel 109 and to the interior sides of two flaps (not shown) located under flaps 117 and 119. Container 101 also includes a vertical support 129 which is partially shown in FIG. 1. Vertical support 129 is integrally connected to exterior panel 103 and exterior panel 107. The portion of vertical support 129 shown in FIG. 1 is secured to the interior side of panel 107. Vertical support 137 is integrally connected to exterior panel 109 and to exterior panel 105. The portion of support 137 shown in FIG. 1 is secured to the interior side of exterior panel 109. The portions shown of horizontal supports 131 and 135 are integrally connected to the exterior panels 107 and 109, respectively, and secured to the interior sides of exterior panels 107 and 109, respectively. The portions of horizontal supports 131 and 135 not shown are integrally connected to flaps (not shown) that are used to form the top side of the container 101.

Figure 2:
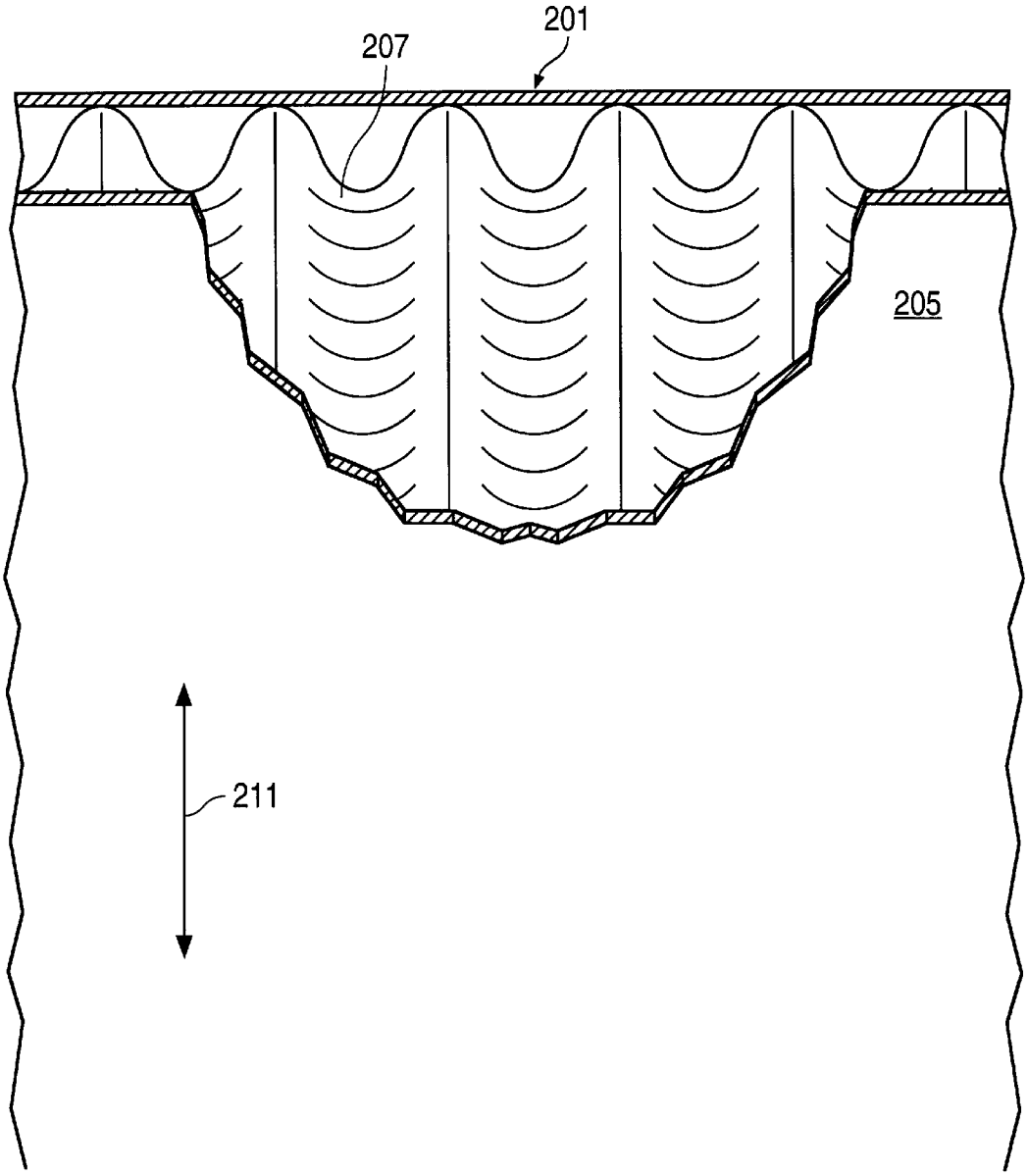
FIG. 2 is a cut-away view of corrugated fiberboard.

Referring to FIG. 2, in one embodiment, reinforced container 101 is made of corrugated fiberboard, or more commonly known as corrugated cardboard. Typically, a sheet of corrugated fiberboard includes flutes 207 enclosed by outer fiberboard liners 201 and 205. These flutes 207 give the corrugated fiberboard increased stacking strength in the direction that the flutes run. FIG. 2 shows the flutes running in a vertical direction as shown by the arrows 211. Therefore, the corrugated fiberboard in FIG. 2 provides a greater strength in a vertical direction due to the flutes running in that direction. It is understood that the "corrugated direction" of corrugated fiberboard is the direction that the flutes run in the corrugated fiberboard. Thus, the corrugated direction of the fiberboard in FIG. 2 is the vertical direction as shown by arrows 211.

Figure 3:
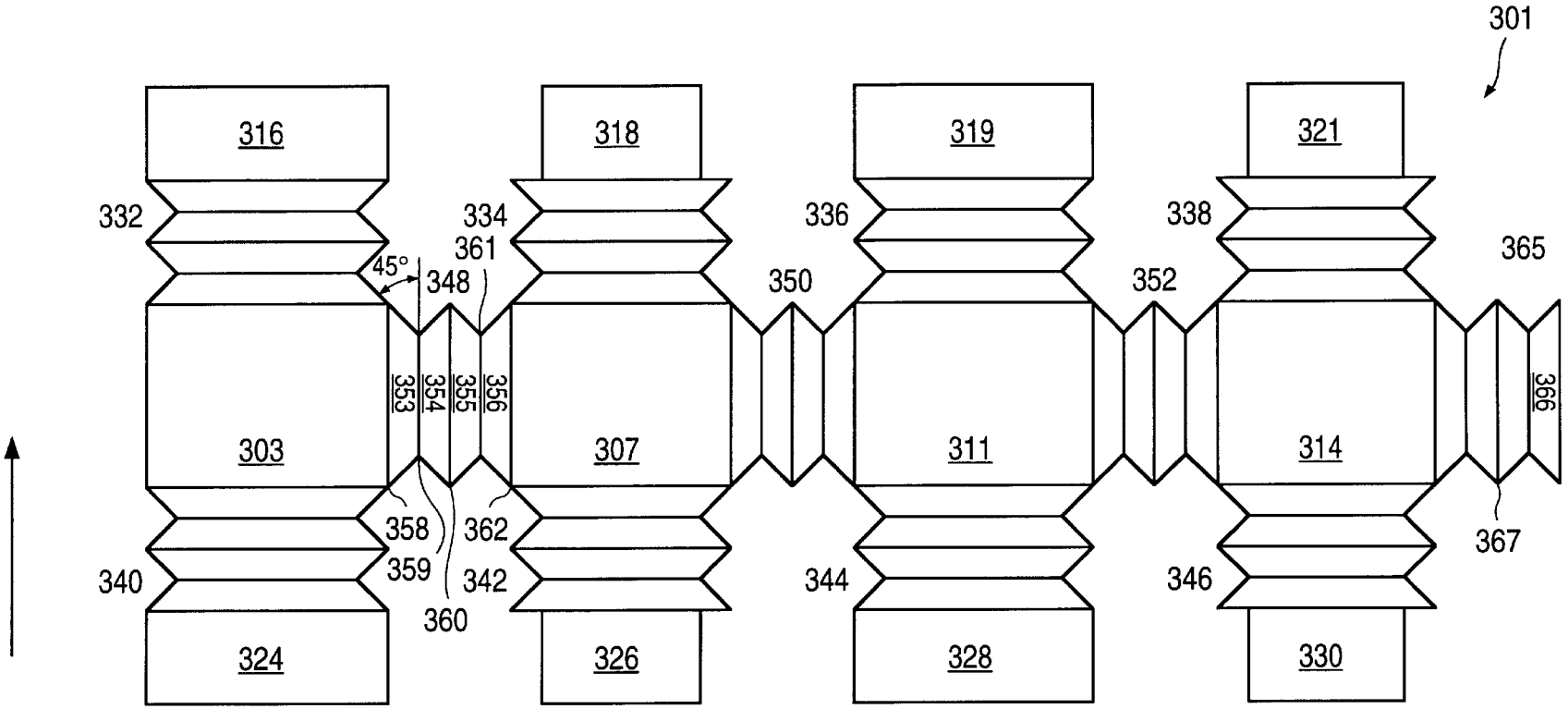
FIG. 3 is a perspective view of one embodiment of a sheet of material according to the present invention.

FIG. 3 shows one embodiment of a flat layout of a sheet of material used to make a reinforced container similar to container 101 in FIG. 1. In the embodiment shown, sheet 301 is made from a sheet of corrugated fiberboard with the corrugated direction being parallel to joint 358 or being in the vertical direction, relative to the view shown in FIG. 3. Sheet 301 includes four exterior side panels 303, 307, 311, and 314 and eight flaps 316, 318, 319, 321, 324, 326, 328, and 330. Top flaps 316, 318, 319, and 321 are used to form the top side and bottom flaps 324, 326, 328, and 330 are used to form the bottom side of the container. Sheet 301 also includes intermediate portions 332, 334, 336, 338, 340, 342, 344, 346, 348, 350, and 352. Each of these intermediate portions are integrally connected to two of the external panels or an external panel and a flap. These intermediate portions are used to form supports for the reinforced container when the container is formed from sheet 301.

In the embodiment shown, intermediate portion 348 includes support panel 353, intermediate support panel 354, intermediate support panel 355, and support panel 356. Support panel 353 is integrally connected to a vertical edge of exterior panel 303 at joint 358. In the embodiment shown, support panel 353 is integrally connected to the entire vertical edge of exterior panel 303. However, in other embodiments, the support panel is integrally connected to a substantial majority of the vertical edge of the exterior panel or flap. In other embodiments, the support panel is integrally connected to less than a substantial majority of a vertical edge of an exterior panel or flap. Support panel 353 is also integrally connected to an edge of intermediate support panel 354 at joint 359. The intermediate support panel 354 is integrally connected to an edge of intermediate support panel 355 at joint 360. The intermediate support panel 355 is integrally connected to an edge of support panel 356 at joint 361. Support panel 356 is integrally connected to one edge of exterior panel 307 at joint 362. Intermediate portions 350 and 352 each include support panels and intermediate support panels like those of intermediate portion 348. Intermediate portions 332, 334, 336, 338, 340, 342, 344, and 346 also include support panels and intermediate support panels like those of intermediate portion 348. However, these portions are integrally connected to one flap and to one exterior panel instead of being integrally connected to two exterior panels as with intermediate portion 348. Intermediate portions 332, 334, 336, and 338 are used to form the top horizontal supports, and intermediate portions 340, 342, 344, and 346 are used to form the bottom horizontal supports.

Sheet 301 includes a portion 365 which is integrally connected to exterior panel 314. Portion 365 is of a similar construction to that of intermediate portion 348 except that intermediate portion 365 is integrally connected to only one exterior panel. In order for sheet 301 to form a container, one side of support panel 366 of intermediate portion 365 is secured to the interior side of exterior panel 303.

To make sheet 301, a sheet of corrugated fiberboard material is fed through a roller die having a pattern to die cut the sheet into the pattern shown in FIG. 3. The roller die also includes scoring edges to score the sheet to form some of the joints. Scoring is where a line in the sheet is crushed so that the sheet can be folded or bent at that line. In the embodiment shown in FIG. 3, joints 358, 360, and 362 of the intermediate portion 348 are formed by scoring. Similar joints in the other intermediate portions are also formed by scoring. In other embodiments, the sheet of fiberboard material is die cut using a stamp having the pattern shown in FIG. 3.

In the embodiment shown, joints 359 and 361 are formed by perforating the sheet of material at those locations. Similar joints of the other intermediate portions are also formed by perforating the sheet of material at those locations. To form a joint by perforating, the sheet of material is stamped with a perforation bar attached to the roller die which cuts through the sheet at intervals along a line. These perforated joints allow the sheet to be folded in an opposite direction from the direction that the sheet is folded at the joints made by scoring. See FIGS. 5A through 5E.

The non integrally connected ends of support panels 353 and 356 and intermediate support panels 354 and 355 are mitered at an approximate 45 degree angle. The non integrally connected ends of the support panels and intermediate support panels of the other intermediate portions are also mitered in a similar manner. Referring again to FIG. 1, this mitering is required so that the horizontal supports 115 and 125 and the vertical support 113 will all fit together against the interior sides of the container when the container is formed from sheet 301.

In the embodiment shown in FIG. 3, top flaps 318 and 321 and bottom flaps 326 and 330 have a lesser width than top flaps 316 and 319 and bottom flaps 324 and 328. In this embodiment, the flaps of the lesser width are the interior flaps and the flaps of the greater width are the exterior flaps. This lesser width enables each of the interior flaps to fit together with two of the horizontal supports against the interior sides of the exterior flaps. Referring again to FIG. 1, flaps 117 and 119 are the bottom interior flaps and are of a lesser width than the two bottom exterior flaps located beneath bottom interior flaps 117 and 119, relative to view shown in FIG. 1. This lesser width enables edge 151 of flap 117 and edge 152 of flap 119 to reside against an edge 155 of support 125. In other embodiments, the interior flaps are of the same width as the exterior flaps.

Figure 4:
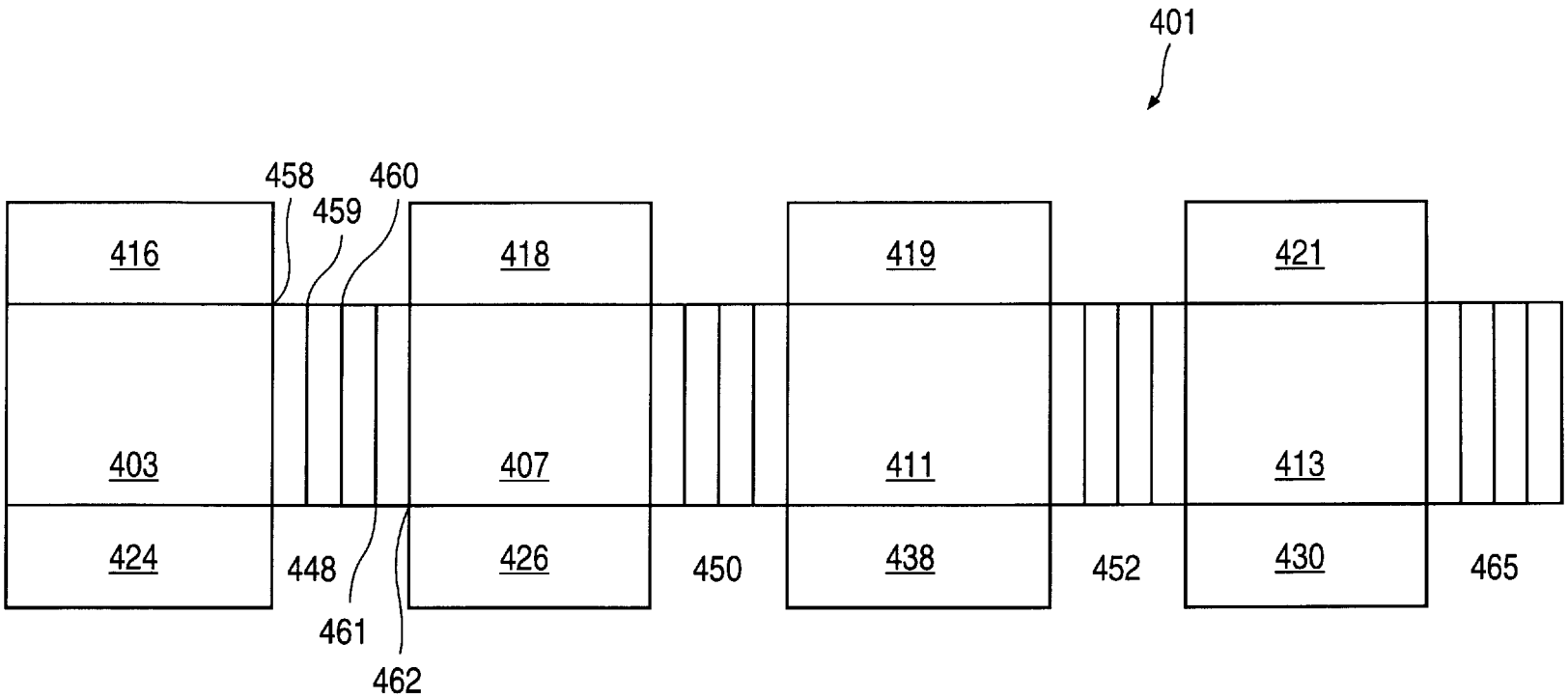
FIG. 4 is a perspective view of one embodiment of a sheet of material according to the present invention.

FIG. 4 shows another embodiment of a flat layout of a sheet of material used to form a reinforced container. Sheet 401 is of a similar construction to sheet 301 except it does not have intermediate portions integrally connected to the flaps. Thus, a container formed from this sheet of material will only have vertical supports and not horizontal supports. Flaps 416 and 424 are integrally connected to exterior panel 403. Flaps 418 and 426 are integrally connected to exterior panel 407. Flaps 419 and 438 are integrally connected to exterior panel 411. Flaps 421 and 430 are integrally connected to exterior panel 413. Intermediate portions 448, 450, 452 are of a similar construction to the intermediate portions of FIG. 3 except that the support panels and intermediate support panels are not mitered like the intermediate portions of sheet 301 due to the fact that a container made from sheet 401 contains no horizontal supports.

As with intermediate portion 348 of sheet 301, the joints 458, 459, 460, 461, and 462 of the intermediate portion 448 of sheet 401 are scored and perforated in a similar manner as with corresponding joints 358, 359, 360, 361, and 362 of sheet 301. The joints of intermediate portions 450 and 452 as well as the joints of portion 465 are also formed in a similar manner as with the corresponding joints of intermediate portion 348.

Figure 5B:
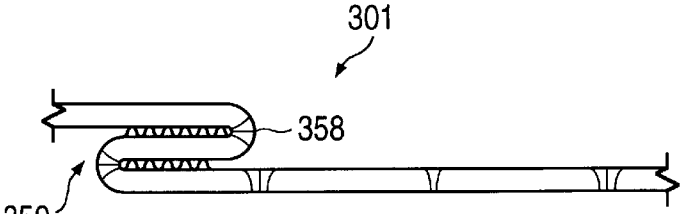
FIGS. 5A through 5E show a series of folds in making a support according to the present invention.
Figure 5D:
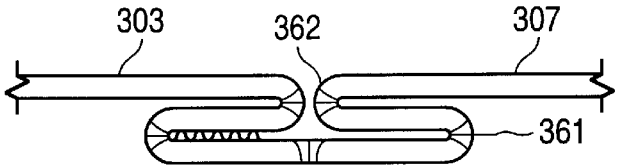
Figure 5E:
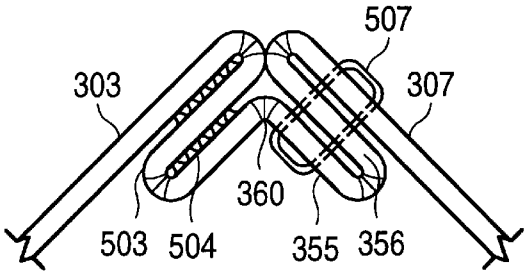
Figure 5A:
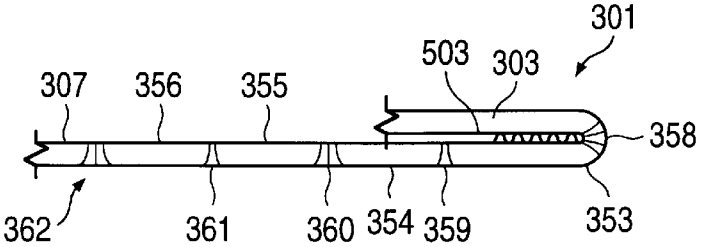
Figure 5C:
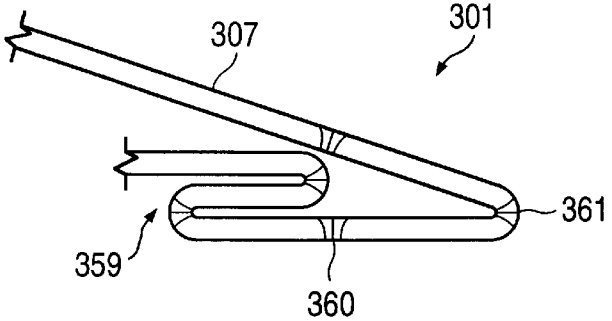

FIGS. 5A through 5E show one embodiment of a series of folds made to sheet 301 to form a support from an intermediate portion. In FIG. 5A, sheet 301 is folded in a first direction at joint 358, a joint formed by scoring. In FIG. 5B, sheet 301 is folded in a second direction at joint 359, a joint formed by perforating. In FIG. 5C, sheet 301 is folded at joint 361 in the same direction that it was folded at joint 359. In FIG. 5D, sheet 301 is folded at joint 362 in the same direction that it was folded at joint 358. In FIG. 5E, sheet 301 is folded at joint 360 in the same direction that it was folded at joints 358 and 362. FIG. 5E shows the orientation of the sheet of material 301 when it has been folded to make a first support where exterior panel 303 and exterior panel 307 are positioned to form an edge of the container. In FIG. 5E, the edges of exterior panels 303 and 307 are positioned adjacent to form an edge of the containers.

In order for the sheet of material to hold its shape when formed into a container, certain portions of the support are secured to the exterior panels and to other portions of the support. Referring back to FIG. 5A, glue 503 is applied to the interior side of exterior panel 303 and to a side of support panel 353. Glue 503 secures support panel 353 to the interior side of exterior panel 303. Glue 502 secures the other side of support panel 353 to a side of intermediate support panel 354. Another method of securing the supports to the exterior panels is shown in FIG. 5E. Stitching 507 is used to secure one side of the intermediate support panel 355 to the first side of a support panel 356 and to secure the other side of support panel 356 to the interior side of exterior panel 307. This stitching runs the length of the support formed by intermediate portion 348. Other securing devices such as staples may be used to secure the support to the exterior panels. In the embodiment of FIG. 5E, no securing means is required to secure the exterior panel 303 to exterior panel 307. The securing of the support panels and intermediate support panels to the exterior panels provides the sheet with the stability needed to hold its shape as a container. Consequently, it is not necessary that exterior panel 303 and exterior panel 307 be touching in order for them to be positioned to form an edge of a container or in order or for the edges of exterior panels 303 and 307 to be positioned adjacent to form an edge of the container.

Intermediate portions 350 and 352 are folded and secured to form a vertical support in a similar manner as shown in FIGS. 5A through 5E. To form the bottom horizontal supports, intermediate portions 340, 342, 344, and 346 are folded in a similar manner as shown in FIGS. 5A through 5E. Intermediate portions 333, 334, 336, 338 are also folded in similar manner as shown in FIGS. 5A through 5E to form the top horizontal supports. In some embodiments, the top and bottom flaps are positioned to form the top and bottom sides of the container before the horizontal supports are secured to the flaps.

Figure 6A:
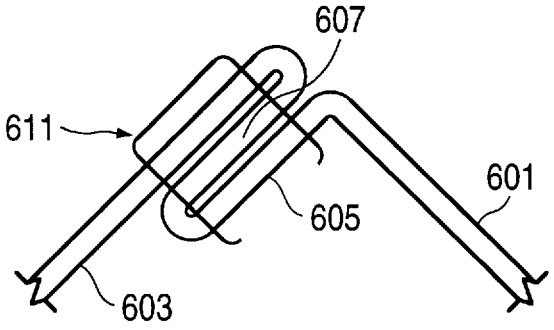
FIGS. 6A through 6C are views of different embodiments of a support integrally connected to two exterior panels positioned to form an edge of a container according to the present invention.
Figure 6B:
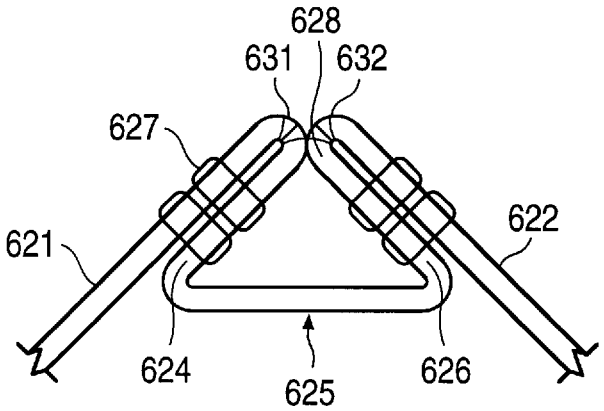
Figure 6C:
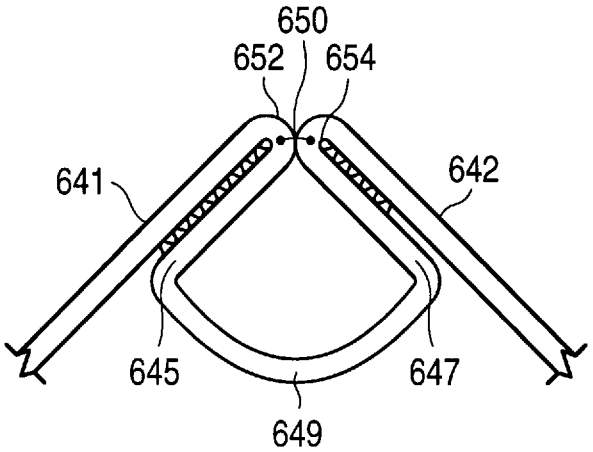

FIGS. 6A through 6C show other embodiments of supports integrally connected to two exterior panels positioned to form an edge of a container. In FIG. 6A, the support is made of only two support panels 607 and 605 which are integrally connected to exterior panels 603 and 601, respectively. The support in FIG. 6A is secured to the interior side of exterior panel 603 with a staple 611. Staple 611 protrudes through exterior panel 603, support panel 607, and support panel 605.

FIG. 6B shows a support that is in the form of a triangle. The support is formed with three panels, support panel 624, intermediate panel 625, and support panel 626. The support is secured to the interior sides of exterior panels 621 and 622 with stitching 627. Stitching 628 secures joints 631 and 632 together to provide extra stability to the container.

FIG. 6C shows another embodiment of a support integrally connected to two exterior panels. In this embodiment, the intermediate panel 609 is bent in an arc which gives the support a circular shape. One side of support panel 645 is secured with glue to the interior side of exterior panel 641, and one side of support panel 647 is secured to the interior side of exterior panel 642 with glue. Stitching 650 secures the joints 652 and 654 together to provide extra stability to the container.

Figure 7:
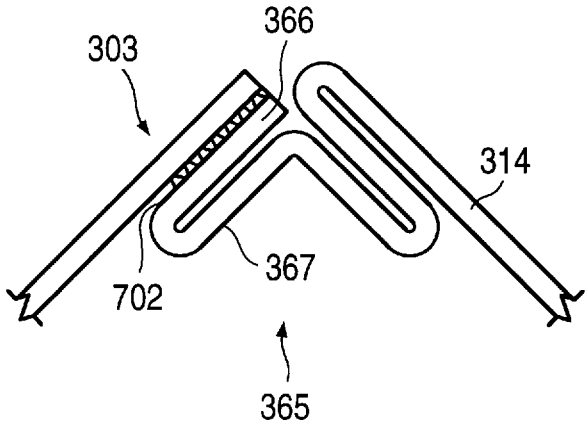
FIG. 7 is one embodiment of a support according to the present invention.

FIG. 7 shows portion 365 folded to make a support. Portion 365 is folded in a similar manner to that of intermediate portion 348. However, because exterior panel 303 and support panel 366 are not integrally connected, no joint exists between exterior panel 303 and support panel 366. Support panel 366 is secured on one side to the interior side of exterior panel 303 and on the other side to intermediate support panel 367.

One advantage of the present invention is that sheet 301 can be partially assembled and still be stored in flat manner as with a partially assembled regular container. To partially assemble a reinforced container from sheet 301, all of the vertical supports are formed and secured to the exterior panels and all of the horizontal supports are formed an secured to the exterior panels. Because support panel 366 is secured to exterior panel 303 in the partially assembled state, the four exterior panels 303, 307, 311, and 314 are in a rectangular configuration as with an assemble container. From this rectangular configuration, the partially assembled container is then flatten to where the interior sides of two adjacent exterior panels face the interior sides of the other two exterior panels.

Although the containers in the embodiments shown are made with corrugated fiberboard, other materials such as chipboard can be used to make a container from a sheet of material according to the present invention.

It is understood that two items being integrally connected means that the two items are connected and that connection is via the sheet of material from which the two items are made. For example, referring to FIG. 3 support panel 353 is integrally connected to exterior panel 303 at joint 358 because their connection is via the sheet of material from which the panels are made. It is understood that two items that are integrally coupled if they are integrally connected or are integrally connected via another panel or panels integrally connected. For instance, referring to FIG. 3, support panel 353 is integrally coupled to exterior panel 303 by being integrally connected to exterior panel 303. Exterior panel 303 is also integrally coupled to intermediate support panels 354, 355, support panel 356, and exterior panel 307.

In other embodiments, a container may be formed with a combination of different type supports. For example, a container may have vertical supports similar to the one shown in FIG. 5E and horizontal supports similar to one shown in FIG. 6A.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A container comprising:

a first side panel having an interior side;

a second side panel;

a first support integrally connected to a first edge of the first side panel, the first support integrally connected to a first edge of the second side panel, the first edge of the first side panel and the first edge of the second side panel positioned to form a first edge of the container;

a first flap;

a second support integrally connected to a second edge of the first side panel, the first support integrally connected to a first edge of the first flap, the second edge of the first side panel and the first edge of the first flap positioned to form a second edge of the container;

wherein the first edge of the first side panel and the second edge of the first side panel are adjacent edges;

wherein an end of at least a portion of the first support is mitered and an end of at least a portion of the second support is mitered such that the at least the portions of the first and second supports fit against the interior side of the first side panel and the mitered end of the at least the portion of the first support is adjacent to the mitered end of the at least the portion of the second support.

2. The container of claim 1 wherein:

the first support is integrally connected to at least a majority of the first edge of the first side panel; and the first support is integrally connected to at least a majority of the first edge of the second side panel.

3. The container of claim 1 further comprising:

a third side panel;

a third support integrally connected to a third edge of the first side panel, the second support integrally connected to a first edge of the third side panel, the first side panel and the third side panel positioned to form a third edge of the container;

wherein an end of at least a portion of the third support is mitered and an second end of at least a portion of the second support is mitered such that the at least the portions of the first and third supports fit against the interior side of the first side panel.

4. The container of claim 1, wherein:

the at least a first potion of the first support includes a first support panel having a first edge integrally connected to the the first edge of the first side panel, wherein a second edge of the first support panel is mitered; and.

5. The container of claim 4 wherein a first side of a first support panel is secured to the interior side of the first side panel.

6. The container of claim 4 wherein a first side of the first support panel is secured to an interior side of the first side panel with glue.

7. The container of claim 4, wherein:

the at least the portion of the first support further includes:

a first intermediate support panel having a first edge integrally connected to a third edge of the first support panel, the first intermediate support having a third edge being mitered;

the first support further includes a second portion, the second portion including:

a second support panel having a first edge integrally connected to the first edge of the second side panel, the second support panel having a third edge being mitered;

a second intermediate support panel having a first edge integrally connected to a second edge of the second support panel, the second intermediate support panel having a third edge being mitered;

wherein a second edge of the first intermediate support panel is integrally connected to a second edge of the second intermediate support panel.

8. The container of claim 7 wherein:

the integral connection of the first edge of the first intermediate support panel to the third edge of the first support panel is perforated; and the integral connection of the first edge of the second intermediate support panel to the second edge of the second support panel is perforated.

9. The container of claim 7 wherein:

a first side of the first support panel is secured to an interior side of the first side panel;

a first side of the second support panel is secured to an interior side of the second side panel;

a second side of the first support panel is secured to a first side of the first intermediate support panel; and a second side of the second support panel is secured to a first side of the second intermediate support panel.

10. The container of claim 1 wherein:

the edge of the container has an interior side, the first support is located on the interior side.

11. The container of claim 1 wherein the first side panel, the second side panel, the first flap, the first support, and the second support are made of corrugated fiberboard.

12. The container of claim 11 wherein:

the fiberboard has a corrugated direction;

the first side panel and the second side panel have vertical edges substantially parallel to the corrugated direction.

13. The container of claim 1 wherein the first side panel and the second side panel are vertical panels.

14. The container of claim 1 wherein the end of the at least a portion of the first support and the end of the at least a portion of the second support are mitered at an approximate 45 degree angles.

15. The container of claim 1 further comprising:

a second flap;

a third support integrally connected to a second edge of the second side panel, the first support integrally connected to a first edge of the second flap, the second edge of the second side panel and the first edge of the second flap positioned to form a third edge of the container;

wherein the first edge of the second side panel and the second edge of the second side panel are adjacent edges;

wherein the second side panel has an interior side;

wherein an end of a second portion of the first support is mitered and an end of at least a portion of the third support is mitered such that the second portion of the first support and the at least the portion of the third support fit against the interior side of the second side panel.

16. The container of claim 15 wherein:

the first flap and the second flap are positionable to form a container side;

an end of a second portion of the second support is mitered and an end of a second portion of the third support is mitered such that the second portion of the second support and the second portion of the third support fit against an interior side of the container.

17. The container of claim 1 wherein the end of at least a portion of the first support is mitered at an angle and the end of at least a portion of the second support is mitered at an angle such that the at least the portions of the first and second supports fit together against the interior side of the first side panel.

18. A sheet of material for making a container comprising:

a first side panel;

a second side panel;

a first flap;

a first intermediate portion integrally connected to the first side panel at a first joint, the first intermediate portion integrally connected to the second side panel at a second joint;

a second intermediate portion integrally connected to the first side panel at a third joint, the second intermediate portion integrally connected to the first flat at a fourth joint;

wherein the first intermediate portion is used to form a first support when the first side panel is positioned with the second side panel to form a first edge of the container;

wherein the second intermediate portion is used to form a second support when a container has been formed from the sheet of material;

wherein an end of the first intermediate portion has a form such that at least a portion of the first support is mitered and an end of the second intermediate portion has a form such that at least a portion of the second support is mitered such that the at least the portions of the first and second supports fit against the interior side of the first side panel with the mitered end of the at least a portion of the first support positioned adjacent to the mitered end of the at least a portion of the second support when a container has been formed from the sheet of material.

19. The sheet of claim 18 wherein the first intermediate portion includes:

a first support panel integrally connected to the first side panel at the first joint; and a second support panel integrally connected to the second side panel at the second joint;

the first support panel and the second support panel are integrally coupled.

20. The sheet of claim 19 wherein the first intermediate portion further includes:

a first intermediate support panel integrally connected to the first support panel at a fifth joint;

a second intermediate support panel integrally connected to the second support panel at a sixth joint;

wherein the first intermediate support panel and the second intermediate support panel are integrally connected at a seventh joint; and wherein the sheet of material is folded at the first joint, the second joint, the fifth joint, the sixth joint, and the seventh joint to form the first support when the sheet is formed into a container.

21. The sheet of claim 20 wherein the first, fifth, and seventh joints are folded in a first direction when the first side panel is positioned with the second side panel to form the first edge of the container;

the second and sixth joints are folded in a second direction when the first side panel is positioned with the second side panel to form the first edge of the container; and the first direction is in the opposite direction of the second direction.

22. The sheet of claim 20 wherein:

the first, fifth, and seventh joints are formed by scoring the sheet; and the second and sixth joints are formed by perforating the sheet.

23. The sheet of claim 20 wherein the first, fifth, and seventh joints each extend out farther from the end of the first intermediate support than each of the second and fourth joints.

24. The sheet of claim 18 further comprising;

a third side panel;

a third intermediate portion integrally connected to the first side panel at a fifth joint, the third intermediate portion integrally connected to the third side panel at a sixth joint;

wherein the third intermediate portion is used to form a third support when the first side panel is positioned with the third side panel to form a second edge of the container;

wherein an end of the third intermediate portion has a form such that at least a portion of the third support is mitered and a second end of the second intermediate portion has a form such that a second end of the at least the portion of the second support is mitered such that the at least the portions of the third and second supports fit against the interior side of the first side panel.

25. The sheet of claims 24 wherein the first and second joints are substantially parallel;

the third and fourth joints are substantially parallel; and the first and third joints are substantially perpendicular.

26. The sheet of claim 18 further comprising:

a second flap;

a third intermediate portion integrally connected to the second side panel at a fifth joint, the third intermediate portion integrally connected to the second flap at a sixth joint;

wherein the third intermediate portion is used to form a third support when a container has been formed from the sheet of material;

wherein the end of the first intermediate portion has a form such that a second portion of the first support is mitered and an end of the third intermediate portion has a form such that at least a portion of the third support is mitered such that the second portion of the first support and the at least the portion of the third supports fit against the interior side of the second side panel.

27. The sheet of claim 26 wherein:

the first flap and the second flap are position to form a container side;

the end of the second intermediate portion and the end of the third intermediate portion have a form such that a second portion of the second support and a second portion of the third support have mitered ends such that the second portion of the second support and the second portion of the third support fit against the interior side of the container side.

28. The sheet of claim 26 wherein:

the form of the end of the first intermediate portion is generally a saw tooth form;

the form of the end of the second intermediate portion is generally a saw tooth form.

29. The sheet of claim 18 wherein the material is corrugated fiberboard.

30. The sheet of claim 29 wherein:

the corrugated fiberboard having a corrugated direction, the first and second joints are substantially parallel with the corrugated direction.

31. The container of claim 18 wherein the end of the at least a portion of the first support the end of the at least a portion of the second support are mitered at an approximate 45 degree angles.

32. A sheet of material for making a container comprising:

a first exterior panel;

a second exterior panel;

a third exterior panel;

a fourth exterior panel;

a first intermediate portion of a first type integrally connected to the first exterior panel and to the second exterior panel;

a second intermediate portion of the first type integrally connected to the second exterior panel and to the third exterior panel;

a third intermediate portion of the first type integrally connected to the third exterior panel and to the fourth exterior panel;

a first flap integrally coupled to the first exterior panel;

a second flap;

a third flap integrally coupled to the second exterior panel;

a fourth flap;

a fifth flap integrally coupled to the third exterior panel;

a sixth flap;

a seventh flap integrally coupled to the fourth exterior panel;

an eighth flap;

a first intermediate portion of a second type integrally connected to the first exterior panel and to the second flap;

a second intermediate portion of the second type integrally connected to the second exterior panel and to the fourth flap;

a third intermediate portion of the second type integrally connected to the third exterior panel and to the sixth flap;

a fourth intermediate portion of the second type integrally connected to the fourth exterior panel and to the eighth flap;

wherein each intermediate portion of the first type includes:

a first support panel integrally connected at a first joint to one of the exterior panels integrally connected to the intermediate portion, the first support panel having an end mitered at an angle;

a second support panel integrally connected at a second joint to the other of the exterior panels integrally connected to the intermediate portion, the second support panel having an end mitered at an angle;

a first intermediate support panel integrally connected to the first support panel at a third joint, the first intermediate support panel having an end mitered at an angle;

a second intermediate support panel integrally connected to the second support panel at a fourth joint, the second intermediate support panel having an end mitered at an angle;

wherein the first intermediate support panel and the second intermediate support panel are integrally connected at a fifth joint;

wherein the sheet of material is folded at the first joint, the second joint, the third joint, the fourth joint, and the fifth joint to form a support when the sheet is formed into a container;

wherein each intermediate portion of the second type includes:

a first support panel integrally connected at a first joint to an exterior panel integrally connected to the intermediate portion, the first support panel having a first end mitered at an angle and a second end mitered at an angle;

a second support panel integrally connected at a second joint to a flap integrally connected to the intermediate portion, the second support panel having a first end mitered at an angle and a second end mitered at an angle;

a first intermediate support panel integrally connected to the first support panel at a third joint, the first intermediate support panel having a first end mitered at an angle and a second end mitered at an angle;

a second intermediate support panel integrally connected to the second support panel at a fourth joint, the second intermediate support panel having a first end mitered at an angle and a second end mitered at an angle;

wherein the first intermediate support panel and the second intermediate support panel are integrally connected at a fifth joint;

wherein the sheet of material is folded at the first joint, the second joint, the third joint, the fourth joint, and the fifth joint to form a support when the sheet is formed into a container;

a portion integrally connected to the fourth exterior panel, the portion including:

a first support panel integrally connected at a first joint to the fourth exterior panel, the first support panel having an end mitered at an angle;

a second support panel, the second support panel having an end mitered at an angle;

a first intermediate support panel integrally connected to the first support panel at a second joint, the first intermediate support panel having an end mitered at an angle;

a second intermediate support panel integrally connected to the second support panel at a third joint, the second intermediate support panel having an end mitered at an angle;

wherein the first intermediate support panel and the second intermediate support panel are integrally connected at a fourth joint;

wherein the sheet of material is folded at the first joint, the second joint, the third joint, and the fourth joint to form a support when the sheet is formed into a container; and wherein a first side of the second support panel of the portion is secured to an interior side of the first exterior panel when the sheet is formed into a container;

wherein the first, third, fifth, and seventh flaps are positioned to form a first container side when the sheet is formed into a container; and wherein the second, fourth, sixth, and eighth flaps are positionable to form a second container side when the sheet is formed into a container:

wherein the first support panels of the intermediate portions of the first and second types having mitered ends enables each first support panel of the intermediate portions of the first type to be positioned adjacent to a first support panel of an intermediate portion of the second type against an interior side of an exterior panel when the sheet is formed into a container.

33. The sheet of material of claim 32 wherein:

each intermediate portion of the first type includes a portion edge, the portion edge including the edges that are mitered of the first support panel, the second support panel, the first intermediate support panel, and the second intermediate support panel of the intermediate portion of the first type, the portion edge of the intermediate portion of the first type having a generally saw-toothed form;

each intermediate portion of the second type includes a first portion edge, the first portion edge including the first edges that are mitered of the first support panel, the second support panel, the first intermediate support panel, and the second intermediate support panel of the intermediate portion of the second type, the first portion edge of the intermediate portion of the second type having a generally saw-toothed form; and each intermediate portion of the second type includes a second portion edge, the second portion edge including the second edges that are mitered of the first support panel, the second support panel, the first intermediate support panel, and the second intermediate support panel of the intermediate portion of the second type, the second portion edge of the intermediate portion of the second type having a generally saw-toothed form.

34. A container comprising:

four side panels, each side panel having an interior side, the panels forming four container edges of a first type, each container edge of the first type having a generally parallel orientation with respect to the other container edges of the first type;

a plurality of flaps positionable to form a container side, the container side and the four side panels forming four container edges of a second type, each container edge of the second type having a generally perpendicular orientation with respect to each container edge of the first type;

four supports of a first type each located on an interior side of a container edge of the first type;

four supports of a second type each located on an interior side of a container edge of the second type;

wherein each of the four supports of the first type has a mitered end and each of the four supports of the second type has two mitered ends such that each support of the first type fits against the interior sides of the two side panels that form the container edge of the first type in which the support of the first type is located and each support of the second type fits against an interior side of the container side and the interior side of the side panel that form the container edge of the second type in which the support of the second type is located.

35. The container of claim 34 wherein the mitered ends of the four supports of the first type and of the four supports of the second type each having two portions mitered at an approximate 45 degree angles.

* * * * *